US006736680B2

(12) United States Patent
Slack et al.

(10) Patent No.: US 6,736,680 B2
(45) Date of Patent: May 18, 2004

(54) MODULAR JACK ASSEMBLY FOR ETHERNET APPLICATIONS

(75) Inventors: Victor E. Slack, Lewisville, NC (US); Eric C. Laurer, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/196,302

(22) Filed: Jul. 16, 2002

(65) Prior Publication Data

US 2004/0014361 A1 Jan. 22, 2004

(51) Int. Cl.[7] ..... H01R 24/00
(52) U.S. Cl. ..... 439/676; 439/620
(58) Field of Search ..... 439/620, 676, 439/76.1

(56) References Cited

U.S. PATENT DOCUMENTS

| | | | | |
|---|---|---|---|---|
| 5,531,612 A | | 7/1996 | Goodall et al. | 439/541.5 |
| 5,736,910 A | * | 4/1998 | Townsend et al. | 333/181 |
| 6,227,911 B1 | | 5/2001 | Boutros et al. | 439/620 |
| 6,305,987 B1 | * | 10/2001 | Crane, Jr. et al. | 439/676 |

* cited by examiner

*Primary Examiner*—Ross Gushi

(57) ABSTRACT

An electrical connector assembly is shown which includes both full shielding and signal conditioning. The assembly includes a front housing portion in the form of a modular jack, and a rear housing portion which forms a recessed area or "well" for receiving the components for signal conditioning. The components are mounted on a printed circuit board, and placed in the recessed area. The housings are aligned and locked together.

25 Claims, 14 Drawing Sheets

MODULAR JACK ASSEMBLY FOR ETHERNET APPLICATIONS

BACKGROUND OF THE INVENTION

The invention relates to a connection assembly providing signal conditioning and superior shielding for high speed data applications.

Known connector assemblies exist having multiple receptacle connectors in a common housing, which provides a compact arrangement of such receptacle connectors. Such a connector assembly is useful to provide multiple connection ports. Accordingly, such a connector assembly is referred to as a multiple port connector assembly. In preferred arrays, the housing has jacks one above the other, forming a plurality of arrays in stacked arrangement, so-called stacked jack arrangements. The receptacle connectors, that is, modular jacks, each have electrical terminals arranged in a terminal array, and have plug receiving cavities. Specifically, the receptacle connectors are in the form of RJ-45 type modular jacks that establish mating connections with corresponding RJ-45 modular plugs.

For example, as disclosed in U.S. Pat. No. 5,531,612, a connector assembly has two rows of receptacle connectors, that is, modular jacks, arranged side-by-side in an upper row and side-by-side in a lower row in a common housing, which advantageously doubles the number of receptacle connectors without having to increase the length of the housing. The receptacle connectors have plug-receiving sections with plug receiving cavities that are profiled to surround modular plugs that are to be inserted in the cavities. The modular plugs have resilient latches, which engage with latching sections on the modular jacks. The latches are capable of being grasped by hand, and being resiliently bent inwardly toward the plugs to release them from engagement with the latching sections on the modular jacks.

Such connection systems have found utility in office computer networks, where desktops are interconnected to office servers by way of sophisticated cabling. Such networks have a variety of data transmission medium including coaxial cable, fiber optic cable and telephone cable. One such network topography is known as the Ethernet network, which is subject to various electrical standards, such as IEEE 802.3 and others. Such networks have the requirement to provide a high number of distributed connections, yet optimally requires little space in which to accommodate the connections.

Furthermore, such networks now operate at speeds of 1 gigabit and higher which requires significant conditioning to the signals. For instance, it is common to require shielding for controlling electromagnetic radiation per FCC standards, while at the same time controlling electromagnetic interference (EMI) within the assembly, between adjacent connections. It is therefore also a requirement to provide such components within the assembly as magnetic coils, inductors, chip capacitors, and the like, to condition the signals. While the technology exists for conditioning the signals, no connection devices exist which are capable of handling such speeds, while at the same time package the signal conditioning components required to maintain these speeds.

Another design is shown in U.S. Pat. No. 6,227,911 to Boutros et al., which discloses a modular jack assembly having multiple ports for connection to multiple modular jacks. While this assembly further discloses having packaged magnetic assemblies, or other components, this design, as in other attempts to signal condition connection devices, simply adds the components to known connection devices. Therefore the volume within the assembly is inadequate to provide the proper signal conditioning devices for the high speeds now required.

The objects of the inventions are therefore to overcome the shortcomings of the prior art.

SUMMARY OF THE INVENTION

The objects of the invention have been accomplished by providing an electrical connector having signal conditioning, where the connector comprises an electrical connector housing assembly comprised of a first housing portion having a mating face for matingly receiving a complementary connector and a second housing portion having a receiving area for receiving signal conditioning components. A plurality of electrical contacts are positioned on the first housing portion, having contact portions adjacent the mating face for contact with the complementary connector, and connecting portions extending into the receiving area. A plurality of signal conditioning components are positioned in the receiving area, and a plurality of conductor portions are positioned in the receiving area interconnecting the connecting portions and the signal conditioning components. The first and second housing portions having an alignment mechanism to align the first and housings, and the first and second housing portions having a locking mechanism to lock the first and second connectors together.

In the preferred embodiment, the electrical connector conductor portions are defined as circuit traces on a printed circuit board, with the signal conditioning components being positioned on the printed circuit board. The second housing portion receiving area is defined by a floor and an upstanding perimeter wall, the perimeter wall being profiled to receive the printed circuit board. Preferably, the first housing portion is defined as a modular jack housing, with the connecting portions extending along, and spaced from, a rear face of the modular jack housing, whereby the first and second housings are assembled together, with a front wall portion of the upstanding perimeter wall extending between the connecting portions and the rear face of the modular jack housing.

Also preferably, the circuit board has plated through holes adjacent to the front wall portion, and the connecting portions are positioned and electrically connected to the through holes. The alignment mechanism is comprised of a vertical rib positioned on the exterior of the perimeter wall, and complementary grooves positioned on interior surfaces of side walls of the modular jack housing. The rear face is recessed and the grooves extend rearward of the rear face, whereby the side walls of the modular jack housing, partially overlap the perimeter wall, when the complementary grooves overlap the ribs.

Preferably, the second housing portion includes an extending portion, forward of the perimeter wall, and the modular jack housing includes a lower wall positioned adjacent the extending portion when in the assembled position. The extending portion and the modular jack lower wall include complementary locking elements to form the locking mechanism. The locking elements are in the form of dovetail locking elements. The modular jack lower wall is defined by upstanding L-shaped wall portions, including longitudinal wall portions adjacent side walls of the modular jack housing, and transverse wall portions which extend inwardly and towards each other, leaving free ends of the transverse wall portions spaced apart, the free ends being defined with a portion of the dovetail locking elements.

The extending portion is defined by side walls, and a front end wall, the end wall having the complementary portion of the dovetail locking elements defined thereon, the extending portion cooperating with the modular jack housing such that the side walls of the extending portion are slidably receivable between the longitudinal wall portions and the dovetail locking elements at the end wall of the extending portion are received between the spaced-apart free ends of the transverse wall and into locking engagement with the complementary dovetail locking elements.

In another aspect of the invention, a signal conditioned electrical connector comprises an electrical connector housing assembly comprised of a first housing portion having a mating face for matingly receiving a complementary connector, and a second housing portion having a receiving area defined by a floor and an upstanding perimeter wall, for receiving signal conditioning components. A plurality of electrical contacts are positioned on the first housing portion, having contact portions adjacent the mating face for contact with the complementary connector, and connecting portions extending into the receiving area. A plurality of signal conditioning components are positioned in the receiving area, and a plurality of conductor portions are positioned in the receiving area to interconnect the connecting portions and the signal conditioning components. An alignment mechanism is defined on the first and second housings to align the first and housings together.

In the preferred embodiment, the conductor portions are defined as circuit traces on a printed circuit board, with the signal conditioning components being positioned on the printed circuit board. The upstanding perimeter wall is profiled to receive the printed circuit board. The first housing portion is defined as a modular jack housing, with the connecting portions extending along, and spaced from, a rear face of the modular jack housing, whereby the first and second housings are assembled together, with a front wall portion of the upstanding perimeter wall extending between the connecting portions and the rear face of the modular jack housing.

The alignment mechanism is comprised of a vertical rib positioned on the exterior of the perimeter wall, and complementary grooves positioned on interior surfaces of side walls of the modular jack housing. The rear face is recessed and the grooves extend rearward of the rear face, whereby the side walls of the modular jack housing, partially overlap the perimeter wall, when the complementary grooves overlap the ribs.

The first and second housing portions further comprise a locking mechanism to lock the first and second connector housings together. The second housing portion includes an extending portion, forward of the perimeter wall, the modular jack housing includes a lower wall positioned adjacent the extending portion when in the assembled position. The extending portion and the modular jack lower wall include complementary locking elements to form the locking mechanism. The locking elements are in the form of dovetail locking elements.

The modular jack lower wall is defined by upstanding L-shaped wall portions, including longitudinal wall portions adjacent side walls of the modular jack housing, and transverse wall portions which extend inwardly and towards each other, leaving free ends of the transverse wall portions spaced apart, the free ends being defined with a portion of the dovetail locking elements. The extending portion is defined by side walls, and a front end wall, the end wall having the complementary portion of the dovetail locking elements defined thereon, the extending portion cooperating with the modular jack housing such that the side walls of the extending portion are slidably receivable between the longitudinal wall portions and the dovetail locking elements at the end wall of the extending portion are received between the spaced-apart free ends of the transverse wall and into locking engagement with the complementary dovetail locking elements.

DETAILED DESCRIPTION OF THE PREFERRED EMBODIMENT

Figure 1:
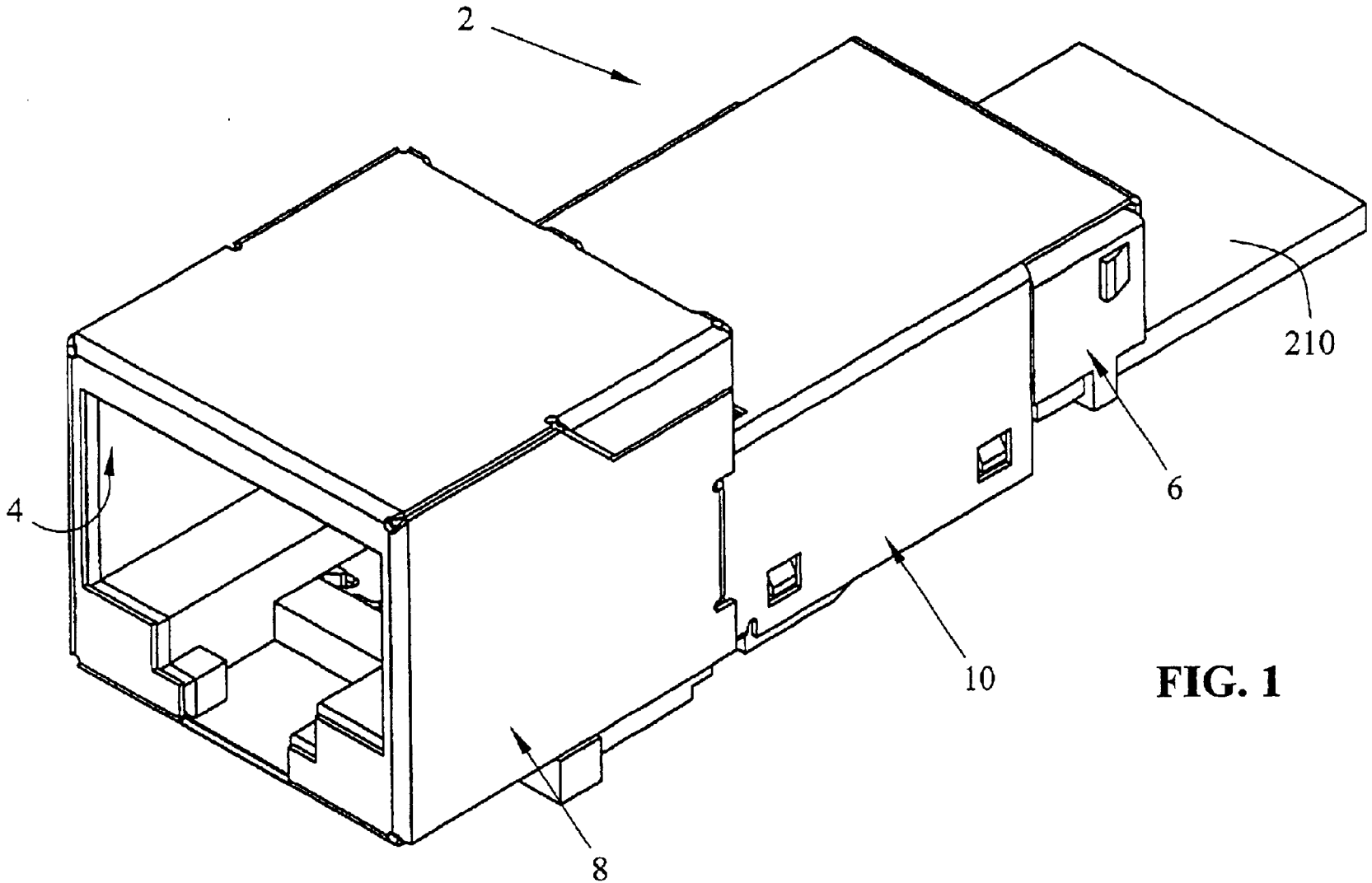
FIG. 1 is a front perspective view of the modular jack assembly.
Figure 2:
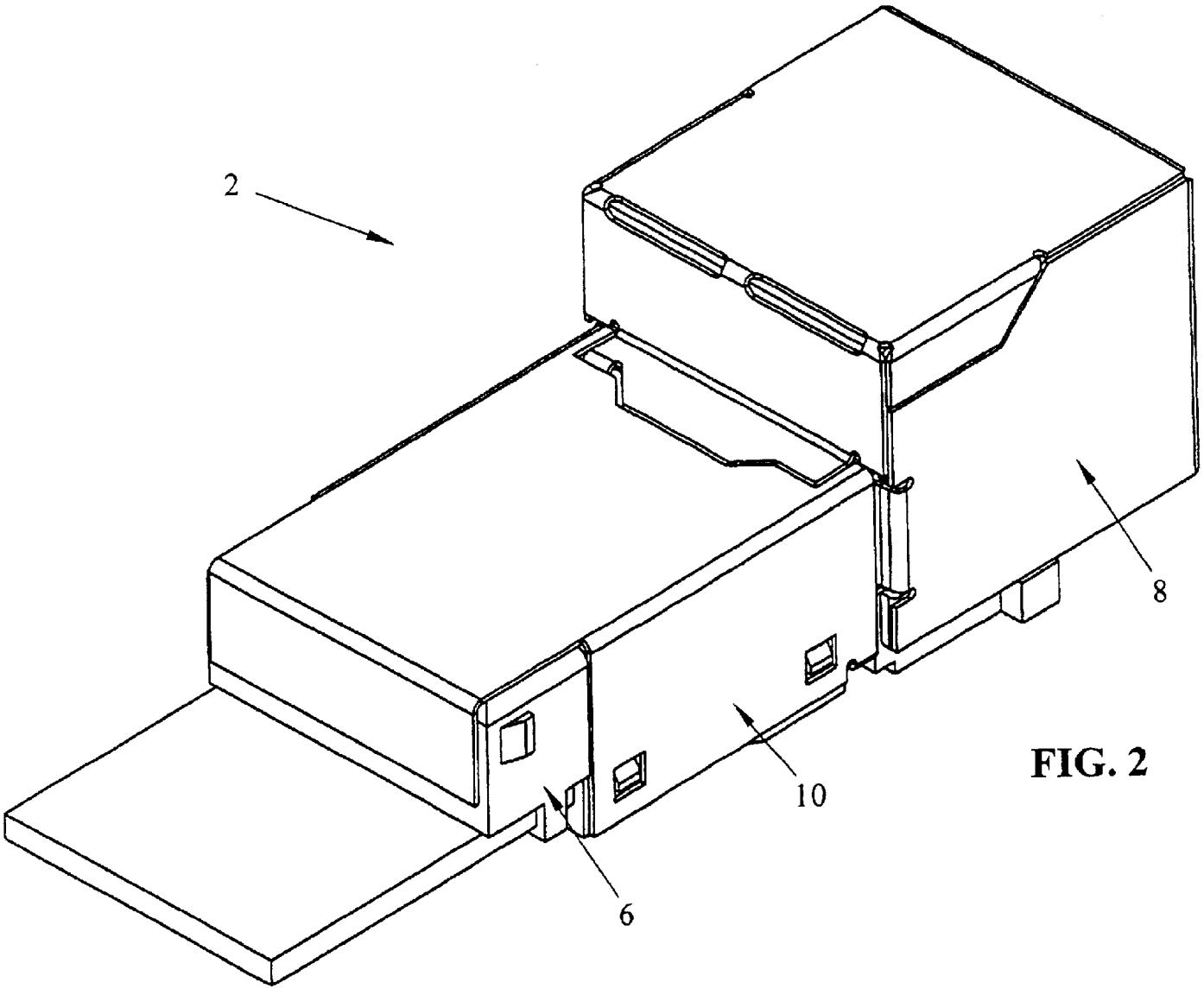
FIG. 2 is a rear perspective view of the assembly shown in FIG. 1.
Figure 3:
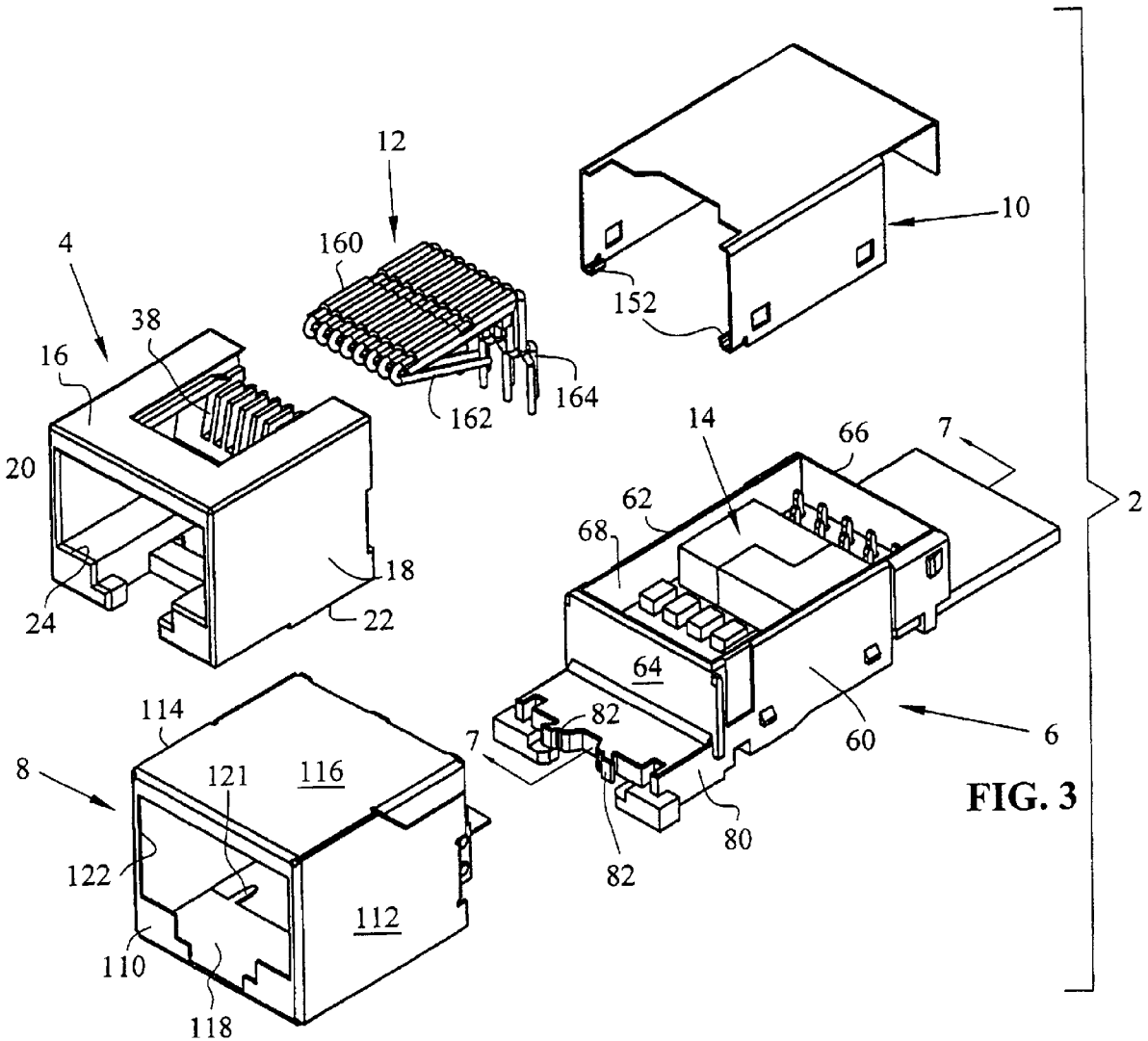
FIG. 3 is an exploded view of the modular jack assembly of FIGS. 1 and 2.
Figure 4:
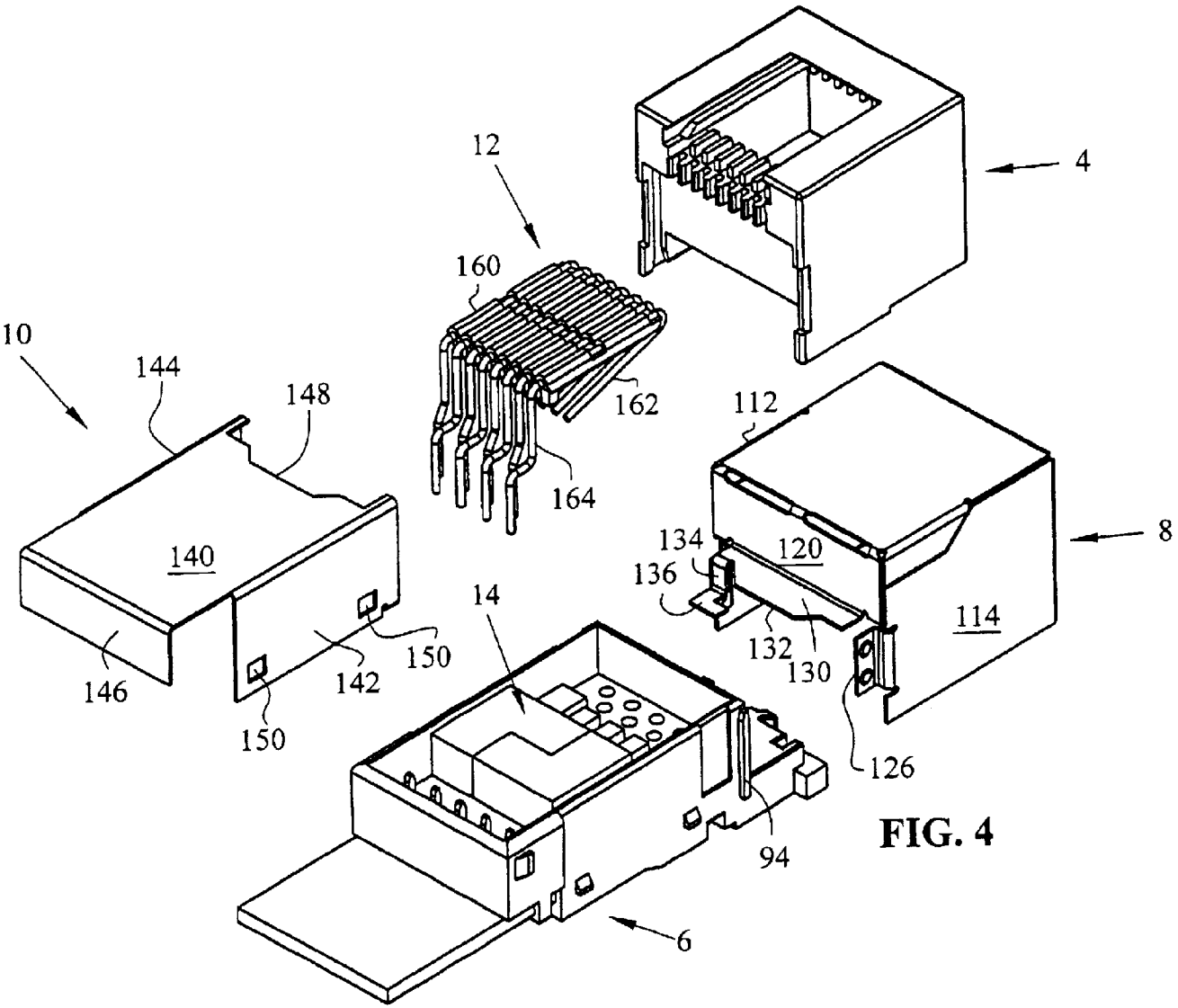
FIG. 4 is an exploded rear perspective view showing the modular jack of FIGS. 1 and 2 exploded.

With reference first to FIGS. 1 and 2, a modular jack assembly is shown generally at 2 and includes a front housing portion 4, a rear housing portion 6, a front shield member 8, and a rear shield portion 10. Preferably the front housing portion 4 and rear housing portion 6 are molded from a plastic insulative material, whereas the front and rear shield members 8, 10 are stamped and formed from a metallic material suitable for shielding purposes. However, it should be appreciated that other types of shielding are also possible, such as laminated materials, plated plastics, and the like. As shown in FIGS. 3 and 4, the modular jack subassembly 2 further includes a terminal insert 12, and the rear housing portion 6 is utilized for retaining a signal conditioning assembly shown best at 14.

Figure 5:
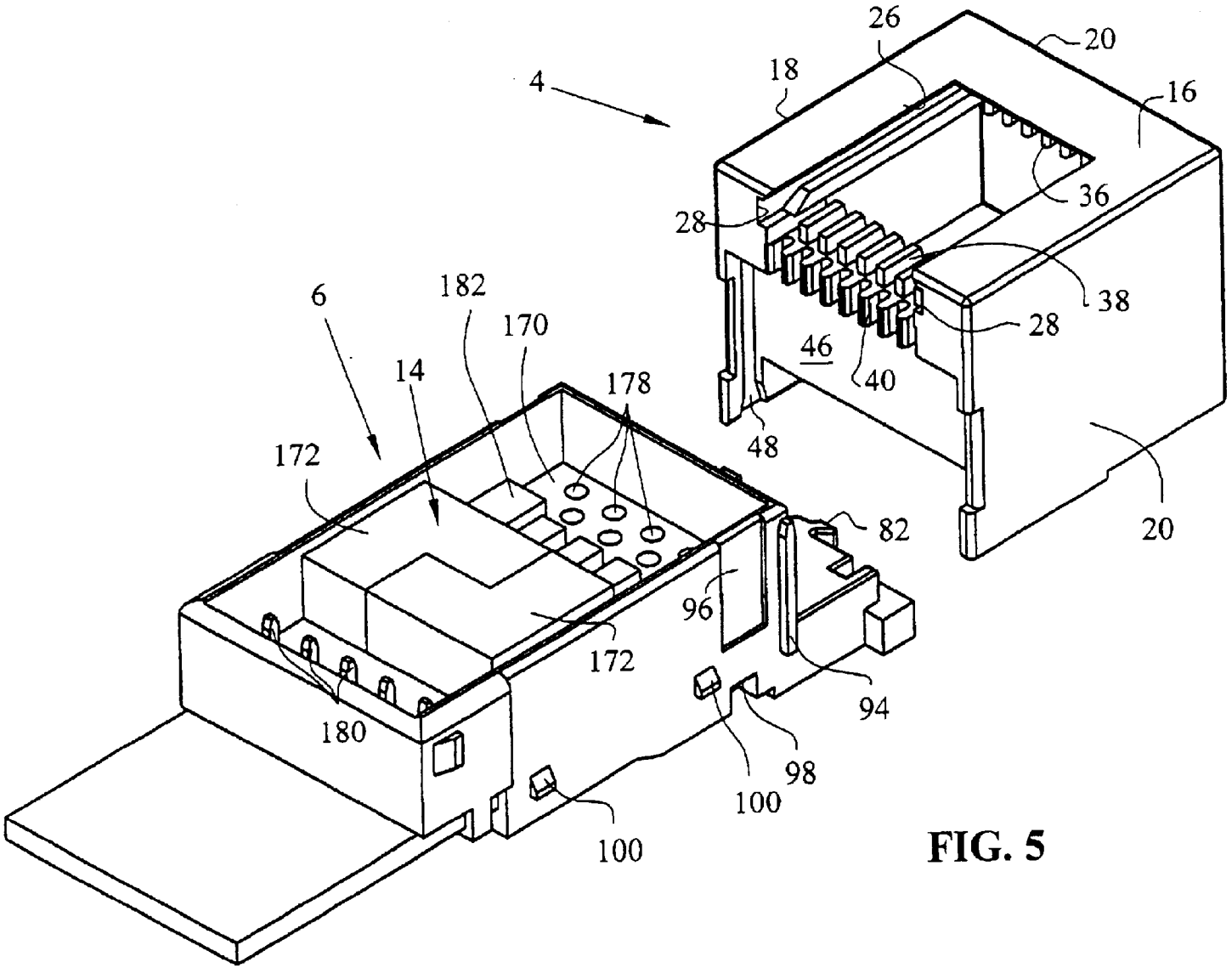
FIG. 5 is a rear perspective view of the housing subassembly of the modular jack of FIGS. 1 and 2.
Figure 6:
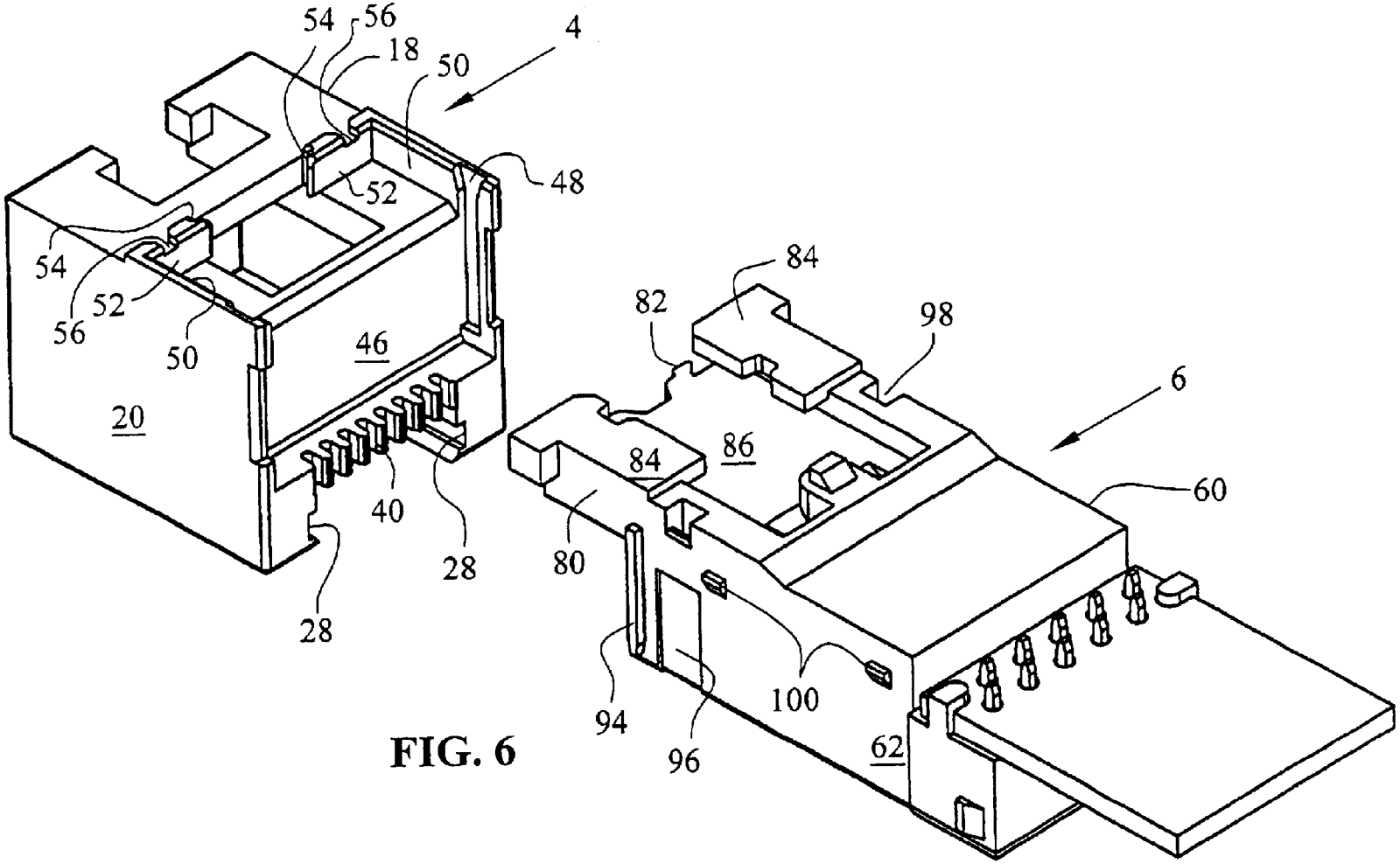
FIG. 6 is a perspective view of the underside of the housing subassembly of FIG. 5.

With respect now to FIGS. 3, 5 and 6, the front housing portion 4 will be described in greater detail. With reference first to FIG. 3, the housing 4 generally includes a top wall 16, side walls 18, 20, and a lower wall at 22. Front wall 20 includes an opening at 24 profiled for the receipt of a modular plug as should be understood to those skilled in the art. As shown in FIG. 5, top wall 16 includes an opening at 26, which defines two channels 28 flanking the opening 26. Each of the channels 28 includes a positioning ledge at 30, as will be described in greater detail herein.

With respect still to FIG. 5, housing 4 includes forward terminal aligning walls 36 adjacent front face 20, rear aligning walls 38, and terminal aligning grooves at 40. The rear face of housing 4 is recessed at 46 and the inside surfaces of walls 18, 20 include grooves at 48, as will be described herein. Finally, as shown best in FIG. 6, side walls 18 and 20 have lower L-shaped extensions defined by longitudinal sections 50 and transverse sections 52. The free ends of the transverse sections 52 include a dovetail configuration shown best at 54, as will be described further herein. Notches 56 are also positioned adjacent to dovetail configuration, as best shown in FIG. 6.

Figure 7:
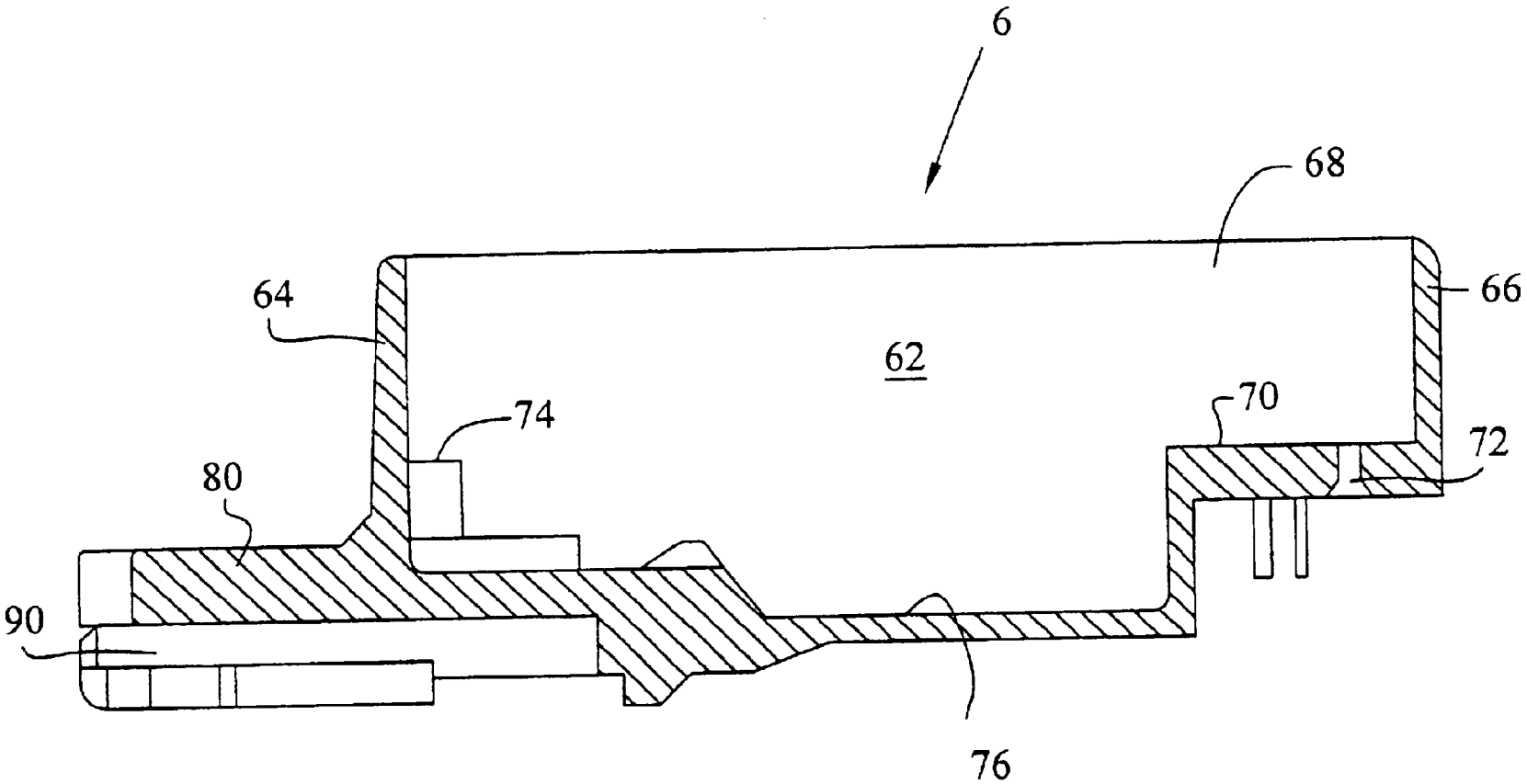
FIG. 7 is a cross-sectional view through lines 7—7 of FIG. 3.

With respect again to FIGS. 3–7, the rear housing 6 will be described in greater detail. Rear housing 6 includes side walls 60, 62, front wall 64, and rear wall 66. Side walls 60, 62 and front and rear walls 64, 66 are of generally common height so as to form an enclosure 68 therein. Within the enclosure 68, and as best shown in FIG. 7, a rear ledge portion 70 is positioned having terminal receiving throughholes at 72. At the front side of enclosure 68 is a further upstanding pedestal support 74, which has a substantially common height as floor 70. Finally, a deep well section is formed at 76, which forms a component receiving section, as will be described herein. With respect now to FIGS. 3, 6 and 7, housing 6 includes a forwardly extending ledge portion at 80, where the front end includes dovetail flanges at 82, as best shown in FIG. 3. Extension 80 also includes wing portions 84, which are spaced from a downwardly facing surface 86, which defines a slot 90 therebetween. With respect to FIG. 6, side walls 60 and 62 include vertical ribs 94, indentations at 96, slots at 98, and latching detents at 100.

With respect now to FIGS. 3 and 4, front shield 8 will be described in greater detail. With respect first to FIG. 3, shield 8 includes a front wall 110, side walls 112 and 114, top wall 116, lower wall 118, and rear wall 120. Lower wall 118 includes alignment tines 121 extending therefrom. As should be appreciated by those skilled in the art, front face 110 includes an opening 122 substantially profiled as opening 24, so as to allow entry of a modular plug. As shown best in FIG. 4, front shield 8 includes two indented tab portions 126 extending from respective side walls 112 and 114. Rear wall 120 includes a horizontally disposed rear ledge 130 having a discontinuously shaped edge 132, which is shown in a substantially trapezoidal shape, and includes a shielding foot 134 on one side thereof. The shielding foot 134 includes a horizontally disposed contact portion 136, which will be described in greater detail herein.

With respect to FIGS. 3 and 4, rear shield member 10 will be described in greater detail. Rear shield 10 includes a top wall 140, side walls 142, 144, and a rear wall portion 146. The leading edge of top wall 140 includes a discontinuously shaped edge 148, which is profiled to complement edge 132 of shield member 8. Side walls 142 and 144 also include latching openings, such as 150 and side wall tab portions 152 (FIG. 3).

With respect to FIGS. 3 and 4, the terminal insert or lead frame 12 will be described in greater detail. Contact lead frame 12 includes an overmolded web portion 160 having reversely bent plug contacts 162 extending forwardly therefrom, and printed circuit board contact portions 164 extending from a rear of the web 160. It should be appreciated that the contacts 164 are tandemly spaced so as to form two rows of contacts in a back-to-back array. The lead frame could be formed through the process shown in U.S. Pat. No. 4,817,283 and fully incorporated herein by reference.

Finally, signal conditioning assembly 14 will be summarily described, whereas this device is shown and described in more detail in co-pending applications to the same assignee filed on even date, and assigned Ser. Nos. 10/196,691 and 10/196,452, fully incorporated herein by reference. As shown best in FIG. 5, assembly 14 is comprised of a printed circuit board 170 having packaged component assemblies 172. In the preferred embodiment, the assemblies 172 each include three electromagnets. Printed circuit board 170 further includes a plurality of throughholes 178 and a plurality of pin terminals 180. Finally, printed circuit board 170 further includes a plurality of signal conditioning components, including at least one decoupling capacitor shown at 182. It should be appreciated that the circuit board includes printed circuit board traces extending between throughholes 178 through to pin terminals 180 so as to incorporate the components such as 182 and the magnetic coil packages 172 within their paths.

Figure 8:
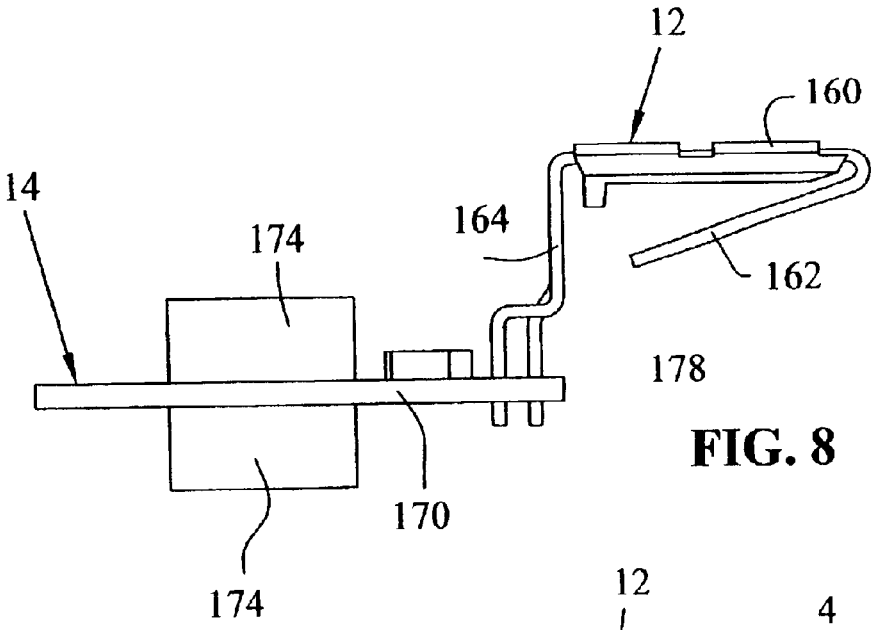
FIGS. 8–14 show progressive views of the assembly of the subject modular jack of FIGS. 1 and 2.
Figure 9:
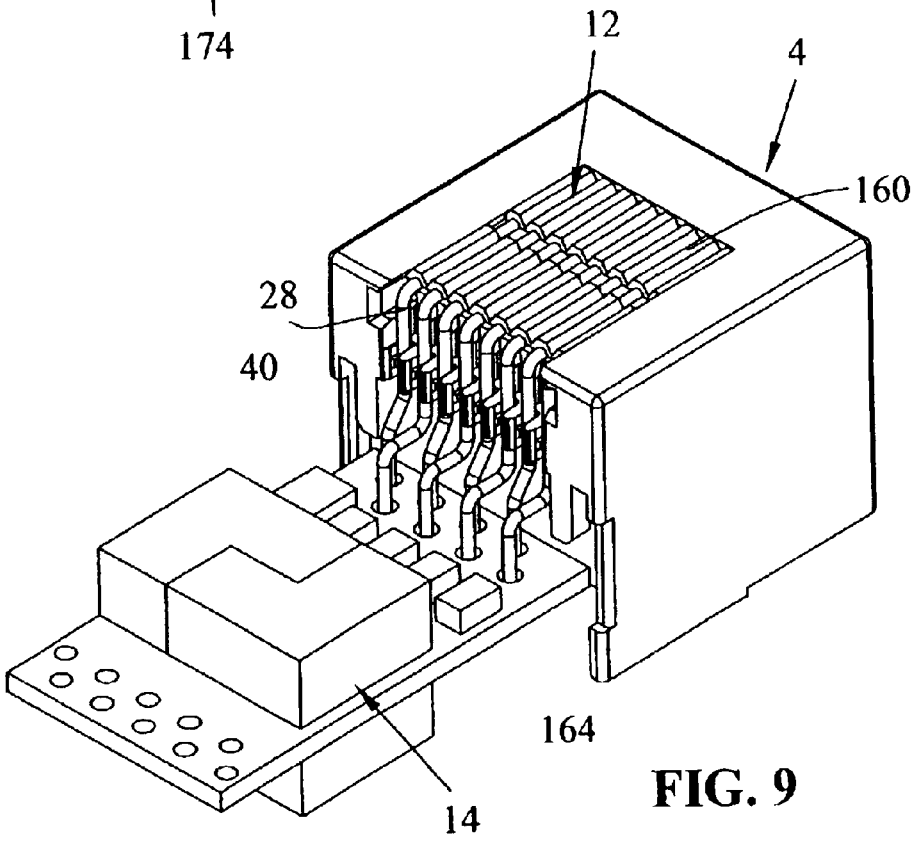

With the components of the assembly 2 as described above, the assembly of the device will now be described with reference to FIGS. 8 through 14. With reference first to FIG. 8, terminal lead frame 12 is positioned with contacts 164 positioned in throughholes 178. It should be appreciated that the contacts 164 would then be soldered or otherwise electrically connected to plated throughholes 178. As shown in FIG. 9, the assembly of the lead frame 12 and printed circuit board assembly 14 is then positioned within housing 4, such that overmolded web 160 is positioned within channels 28 of housing 4. It should be appreciated that terminals 160 will thereafter be positioned adjacent to opening 24 with the tail end of the contacts 162 being positioned in channels 38, and with the contact portions 164 being positioned in the grooves 40, as shown in FIG. 9.

Figure 10:
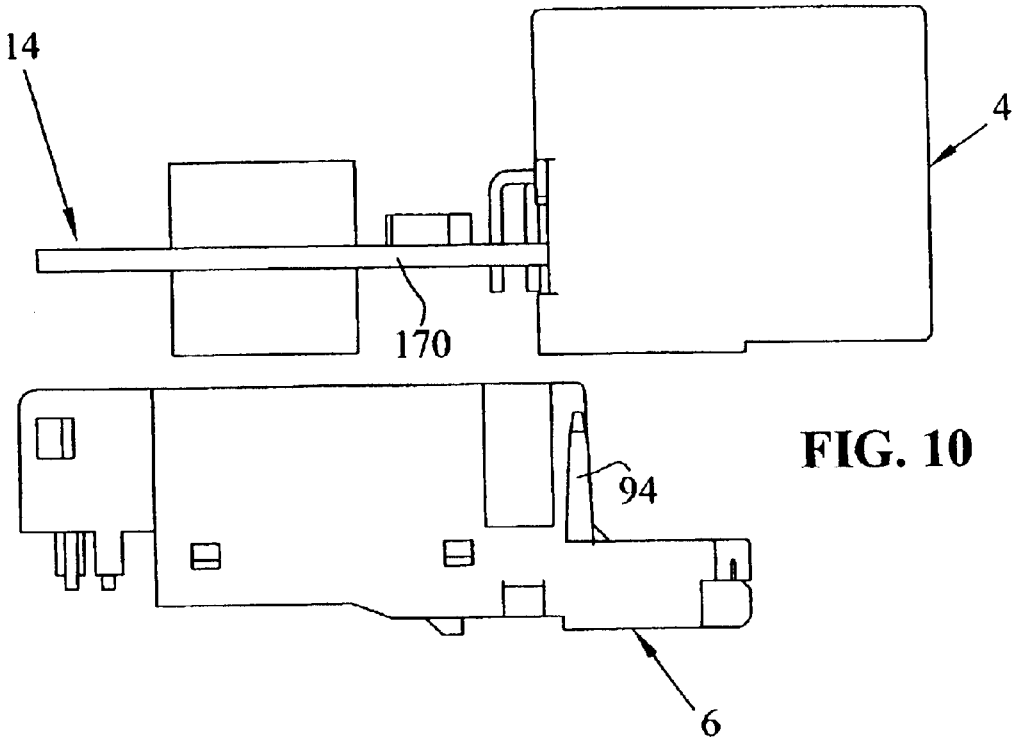
Figure 11:
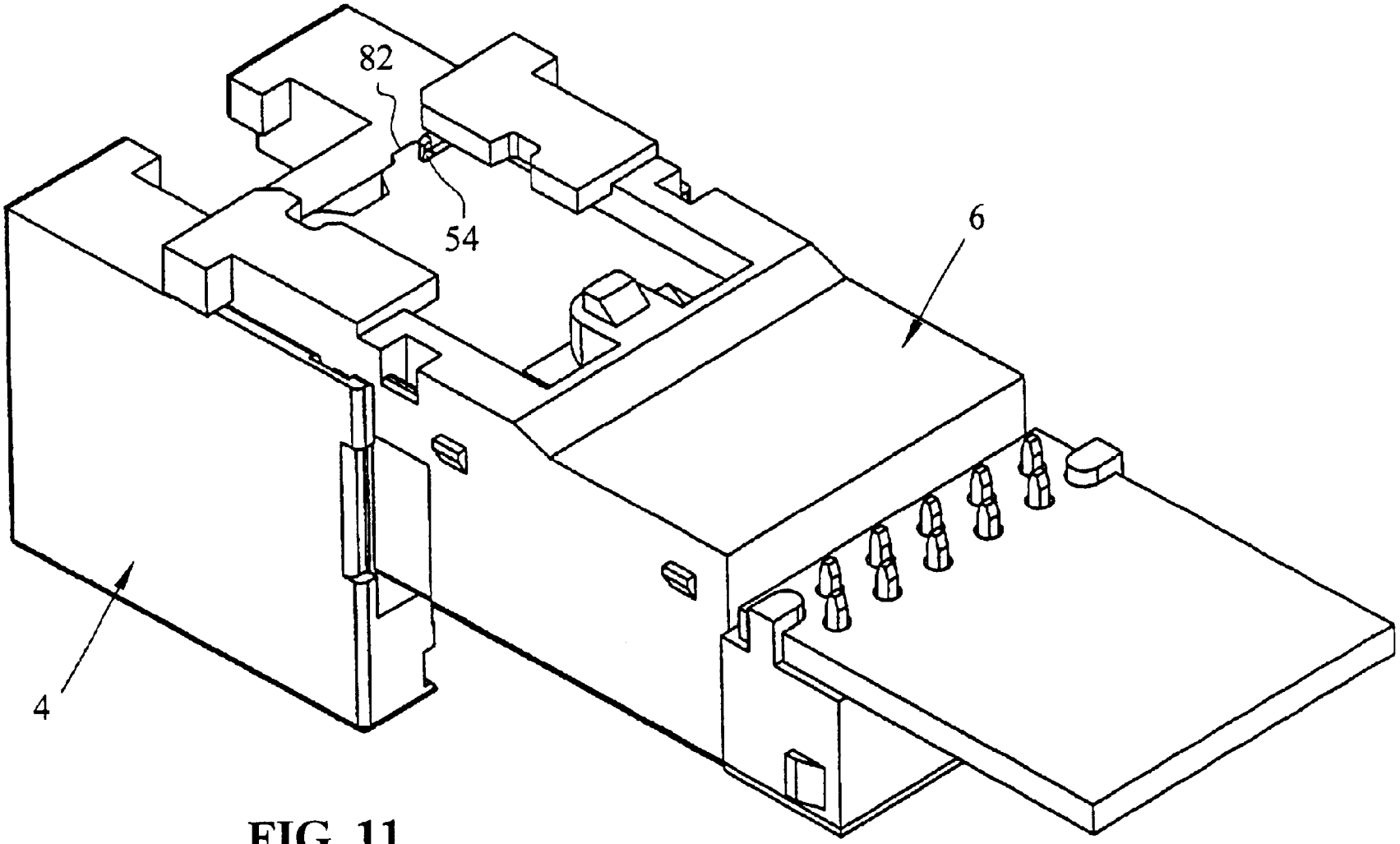

As shown in FIG. 10, the assembly as shown in FIG. 9 is thereafter receivable within rear housing portion 6, such that grooves 48 (FIGS. 5 and 6) receive ribs 94 with printed circuit board 170 being positioned within opening 68 (FIG. 3) of housing portion 6. When the printed circuit board 170 is fully seated within housing 6, the cooperating dovetail configurations 54, 82 are in an overlapping and locking relation, as best shown in FIG. 11. This also positions printed circuit board 170 on ledge 70 and shoulder 74 (FIG. 7).

Figure 12:
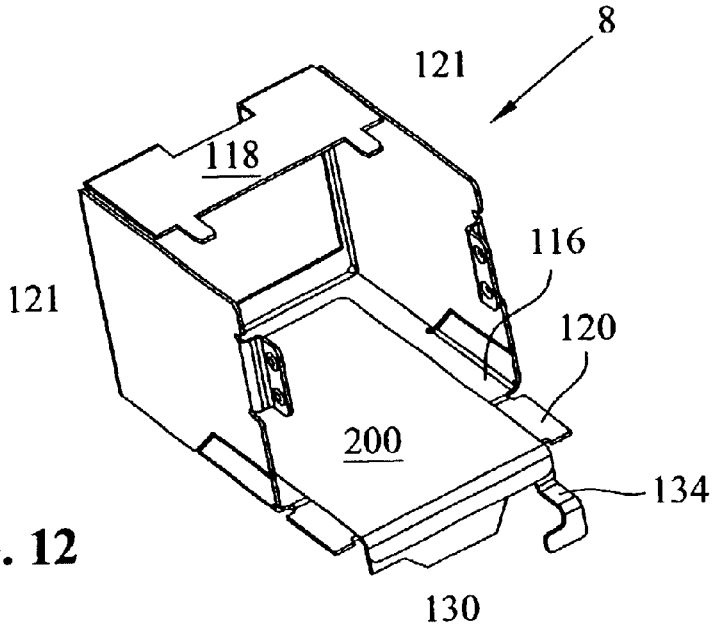

As shown in FIG. 12, the front shield member 8 is shown as an underside perspective view prior to the folding of rear wall portion 120, such that top wall 116 and rear wall 120 are substantially planar. Preferably an insulating film 200 is fixed to the inside surface of top wall 116 and rear wall 120 as shown, so as to partially overlie tab portion 130. It should be appreciated that this prevents shorting contact between the shield and any portion of the terminals of lead frame 12.

Figure 13:
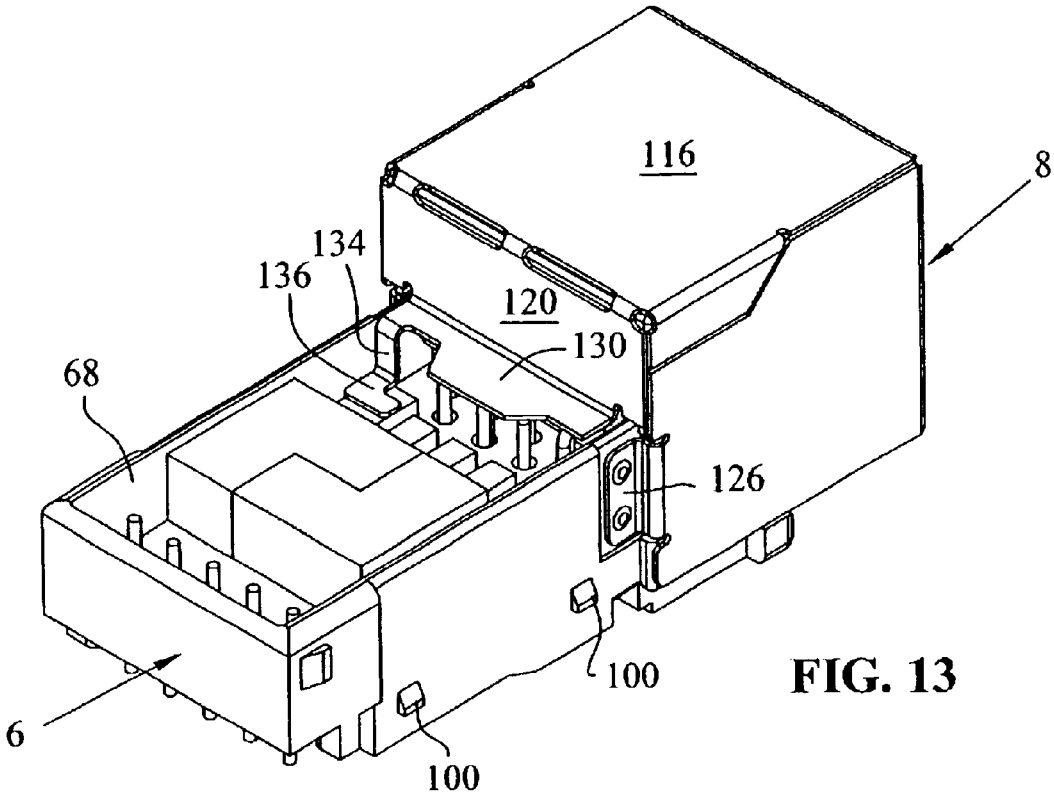

As shown in FIG. 13, the front shield 8 as shown in FIG. 12 may now be slidably received over the assembly shown in FIG. 10 and rear wall portion 120 bent downwardly to substantially cover the rear portion of housing 4. In this position, alignment tines 121 (FIG. 3) align with slots 56 (FIG. 6). This also places tab portions 126 of shield member 8 within apertures 96 (FIG. 6) and places contact foot 136 extending from shield 8 in an overlying manner over decoupling capacitor 182 (FIG. 5). Foot 136 can now be soldered or otherwise interconnected to decoupling capacitor 182. This also places tab portion 130 in a substantially horizontal position partially overlying opening 68 of housing 6. It should be appreciated that potting material or other sealing means is now encapsulated within opening 68 so as to encapsulate all of the terminals and circuitry for sealing purposes.

Figure 14:
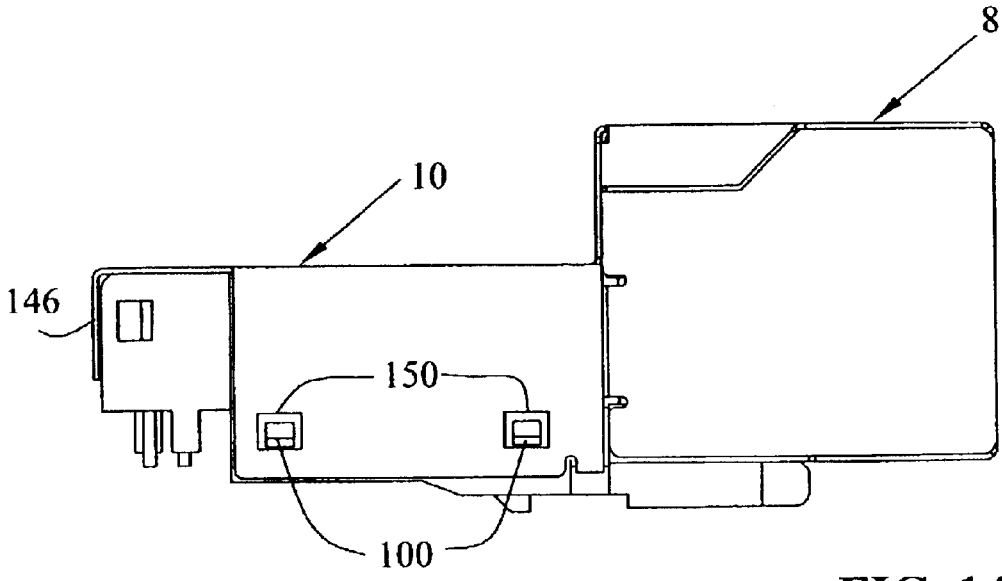
Figure 15:
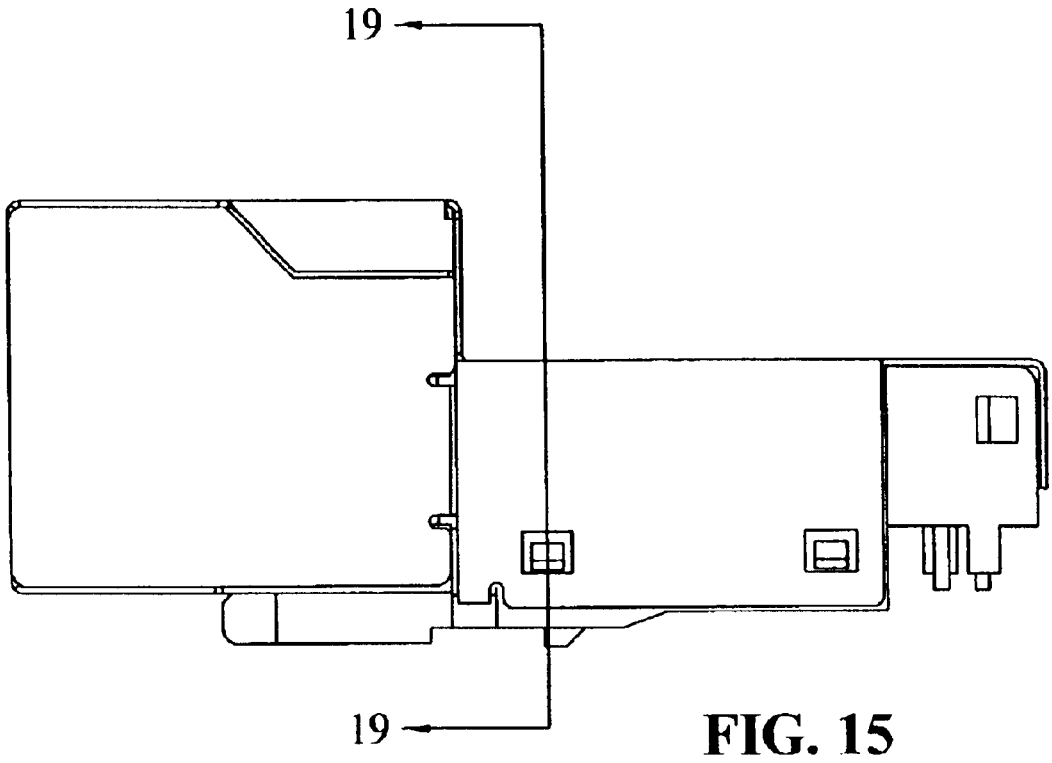
FIG. 15 is a side plan view of the modular jack assembly shown in FIGS. 1 and 2.
Figure 16:
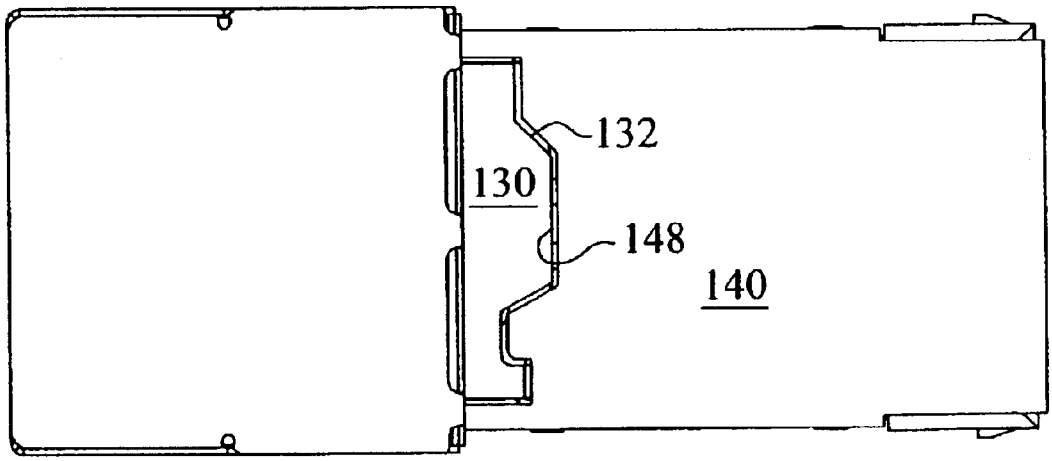
FIG. 16 is a top plan view of the device shown in FIG. 15.
Figure 17:
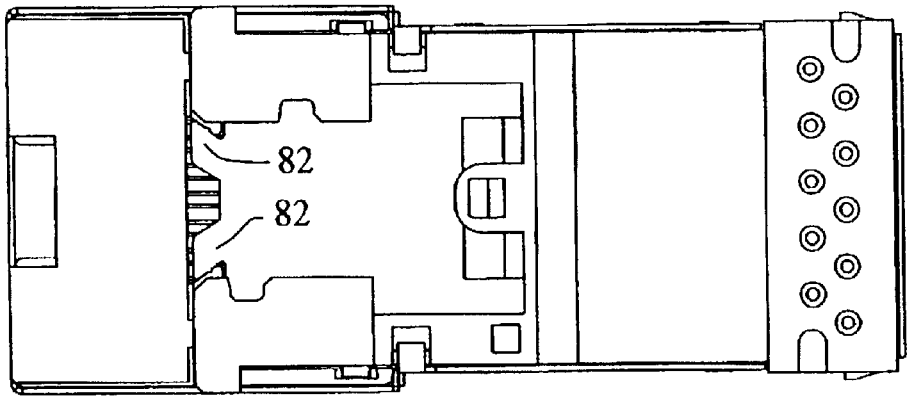
FIG. 17 is a bottom plan view of the device shown in FIG. 15.
Figure 18:
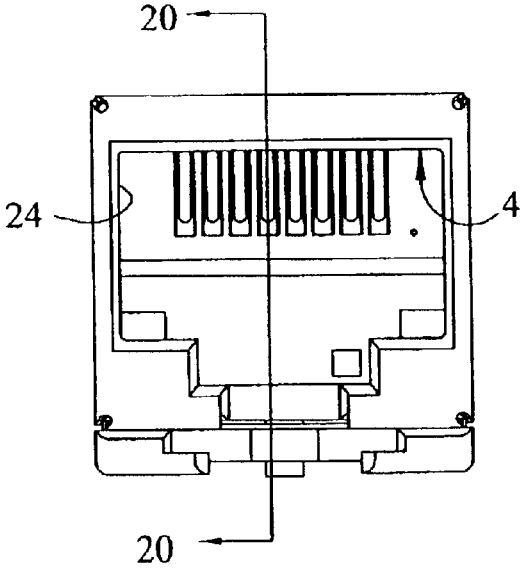
FIG. 18 is a front plan view of the device shown in FIG. 15.
Figure 19:
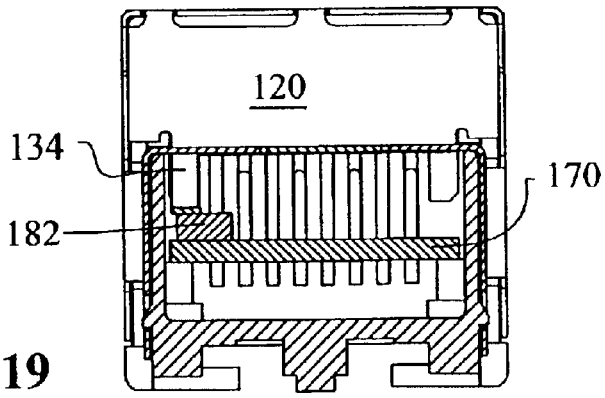
FIG. 19 is a cross-sectional view through lines 19—19 of FIG. 15.
Figure 20:
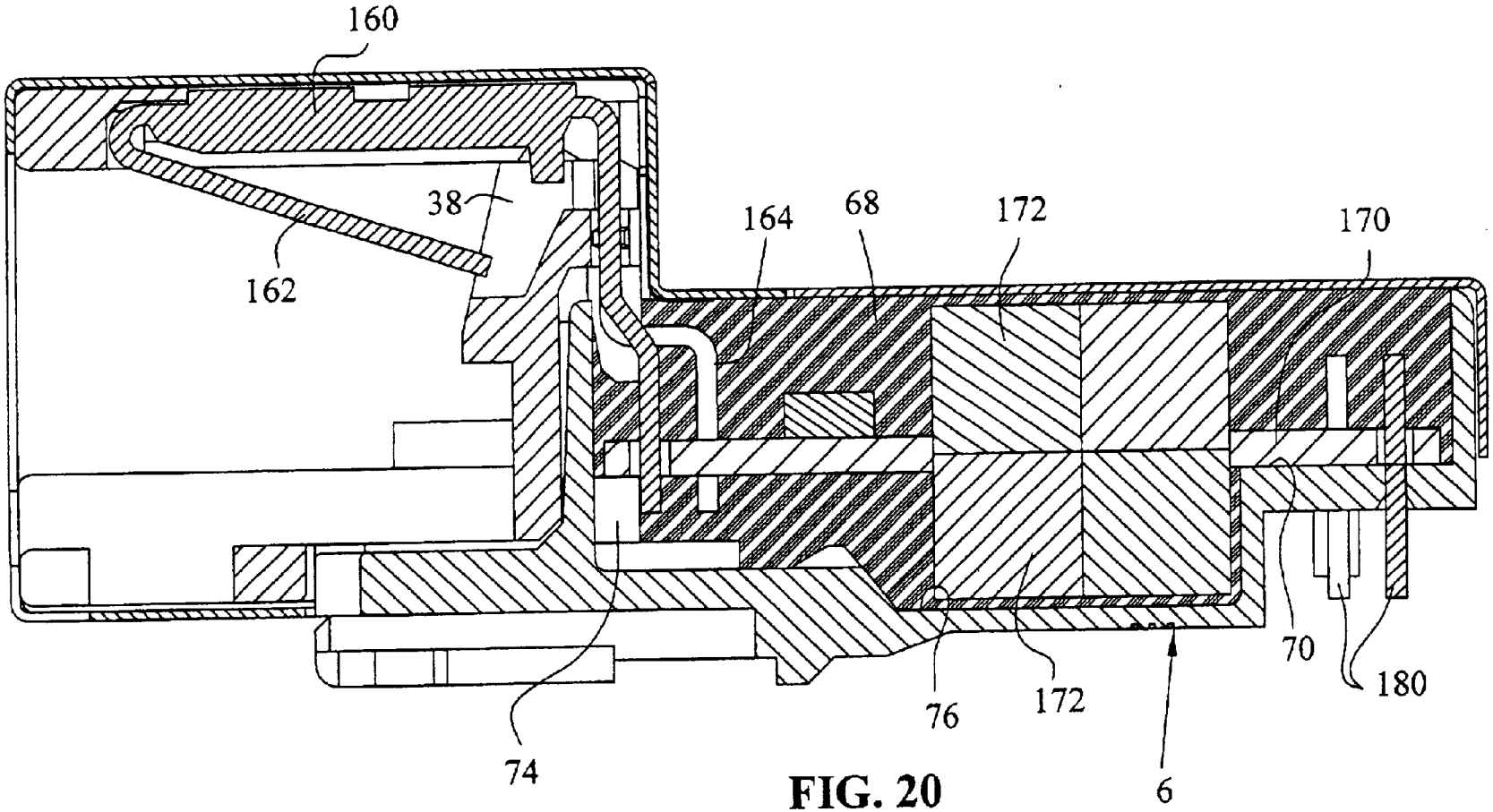
FIG. 20 is a cross-sectional view through lines 20—20 of FIG. 18.

Finally, as shown in FIG. 14, shield member 10 is slidably received over housing portion 6, until apertures 150 snap in place behind latching lugs 100. This positions edge 132 of tab portion 130 within its similarly shaped opening 148, yet maintaining the tab 134 extending downwardly into cavity 68 and contacting decoupling capacitor 182, as best shown in FIGS. 16 and 19. Also as best shown in FIGS. 17, 18 and 20, contacts 162 are disposed adjacent to opening 24 of front housing portion 4 and further positions contact sections 164 within opening 68 of housing 6 and sealed therein. This also positions and packages magnetic coils 172 neatly within the package, with the lower coils 172 being positioned in the lower well section 76, as shown in FIG. 20, with the rear terminal portions 180 available for customer connection.

As designed, the modular jack assembly performs as an interface for Ethernet applications. The design also provides for an efficiently packaged assembly. The two-piece housing assembly allows for the front housing 4 to be profiled as a modular jack housing, whereas the rear housing 6 can be used to house the signal conditioning components. The alignment 48, 94 allows proper alignment of the printed circuit board 170 with the opening 68. The two housing members are locked together by way of the cooperating dovetail configuration 54, 82. Moreover, as the device is both fully shielded, as well as coupled to signal conditioning components, the device can be used at speeds for Ethernet application.

What is claimed is:

1. An electrical connector having signal conditioning, the connector comprising:

an electrical connector housing assembly comprised of:

a first housing portion having a mating face for matingly receiving a complementary connector;

a second housing portion having a receiving area for receiving signal conditioning components, said receiving area being positioned rearward of said first housing portion;

a plurality of electrical contacts positioned in said first housing portion, having contact portions adjacent said mating face for contact with the complementary connector, and connecting portions extending from said first housing portion and into said receiving area;

a plurality of signal conditioning components positioned in said receiving area;

a plurality of conductor portions positioned in said receiving area interconnecting said connecting portions and said signal conditioning components;

said first and second housing portions having an alignment mechanism to align said first and housings;

said first and second housing portions having a locking mechanism to lock said first and second connectors together; and the movement of the first housing portion and second housing portion together, by way of said alignment mechanism, also affecting movement of said connecting portions into said receiving area.

2. The electrical connector of claim 1, wherein said conductor portions are defined as circuit traces on a printed circuit board, with said signal conditioning components being positioned on said printed circuit board.

3. The electrical connector of claim 2, wherein said second housing portion receiving area is defined by a floor and an upstanding perimeter wall, said perimeter wall being profiled to receive said printed circuit board.

4. The electrical connector of claim 2, wherein said first housing portion is defined as a modular jack housing, with said connecting portions extending along, and spaced from, a rear face of said modular jack housing, whereby said first and second housings are assembled together, with a front wall portion of said upstanding perimeter wall extending between said connecting portions and said rear face of said modular jack housing.

5. The electrical connector of claim 4, wherein said circuit board has plated through holes adjacent to said front wall portion, and said connecting portions are positioned and electrically connected to said through holes.

6. The electrical connector of claim 4, wherein said alignment mechanism is comprised of a vertical rib positioned on the exterior of said perimeter wall, and complementary grooves positioned on interior surfaces of side walls of said modular jack housing.

7. The electrical connector of claim 6, wherein said rear face is recessed and said grooves extend rearward of said rear face, whereby said side walls of said modular jack housing, partially overlap said perimeter wall, when said complementary grooves overlap said ribs.

8. The electrical connector of claim 4, wherein said second housing portion includes an extending portion, forward of said perimeter wall, said modular jack housing including a lower wall positioned adjacent said extending portion when in the assembled position.

9. The electrical connector of claim 8, wherein said extending portion and said modular jack lower wall include complementary locking elements to form said locking mechanism.

10. The electrical connector of claim 9, wherein said locking elements are in the form of dovetail locking elements.

11. The electrical connector of claim 10, wherein said modular jack lower wall is defined by upstanding L-shaped wall portions, including longitudinal wall portions adjacent side walls of said modular jack housing, and transverse wall portions which extend inwardly and towards each other, leaving free ends of said transverse wall portions spaced apart, said free ends being defined with a portion of said dovetail locking elements.

12. The electrical connector of claim 11, wherein said extending portion is defined by side walls, and a front end wall, said end wall having the complementary portion of said dovetail locking elements defined thereon, said extending portion cooperating with said modular jack housing such that said side walls of said extending portion are slidably receivable between said longitudinal wall portions and the dovetail locking elements at the end wall of the extending portion are received between the spaced-apart free ends of the transverse wall and into locking engagement with said complementary dovetail locking elements.

13. A signal conditioned electrical connector comprising an electrical connector housing assembly comprised of a first housing portion having a mating face for matingly receiving a complementary connector, a second housing portion having a receiving area defined by a floor and an upstanding perimeter wall, for receiving signal conditioning components, a plurality of electrical contacts positioned on said first housing portion, having contact portions adjacent said mating face for contact with the complementary connector, and connecting portions extending along, and spaced from, a rear face of said first housing portion, and extending into said receiving area, a plurality of signal conditioning components positioned in said receiving area, a plurality of conductor portions positioned in said receiving area interconnecting said connecting portions and said signal conditioning components, and an alignment mechanism defined on said first and second housings to align said first and second housings together, whereby said first and second housings are assembled together, with a front wall portion of said upstanding perimeter wall extending between said connecting portions and said rear face of said first housing portion.

14. The electrical connector of claim 13, wherein said conductor portions are defined as circuit traces on a printed circuit board, with said signal conditioning components being positioned on said printed circuit board.

15. The electrical connector of claim 14, wherein said upstanding perimeter wall is profiled to receive said printed circuit board.

16. The electrical connector of claim 14, wherein said first housing portion is defined as a modular jack housing.

17. The electrical connector of claim 16, wherein said circuit board has plated through holes adjacent to said front wall portion, and said connecting portions are positioned and electrically connected to said through holes.

18. The electrical connector of claim 16, wherein said alignment mechanism is comprised of a vertical rib positioned on the exterior of said perimeter wall, and complementary grooves positioned on interior surfaces of side walls of said modular jack housing.

19. The electrical connector of claim 18, wherein said rear face is recessed and said grooves extend rearward of said rear face, whereby said side walls of said modular jack housing, partially overlap said perimeter wall, when said complementary grooves overlap said ribs.

20. The electrical connector of claim 16, wherein said first and second housing portions further comprise a locking mechanism to lock said first and second connector housings together.

21. The electrical connector of claim 20, wherein said second housing portion includes an extending portion, forward of said perimeter wall, said modular jack housing including a lower wall positioned adjacent said extending portion when in the assembled position.

22. The electrical connector of claim 21, wherein said extending portion and said modular jack lower wall include complementary locking elements to form said locking mechanism.

23. The electrical connector of claim 22, wherein said locking elements are in the form of dovetail locking elements.

24. The electrical connector of claim 23, wherein said modular jack lower wall is defined by upstanding L-shaped wall portions, including longitudinal wall portions adjacent side walls of said modular jack housing, and transverse wall portions which extend inwardly and towards each other, leaving free ends of said transverse wall portions spaced apart, said free ends being defined with a portion of said dovetail locking elements.

25. The electrical connector of claim 24, wherein said extending portion is defined by side walls, and a front end wall, said end wall having the complementary portion of said dovetail locking elements defined thereon, said extending portion cooperating with said modular jack housing such that said side walls of said extending portion are slidably receivable between said longitudinal wall portions and the dovetail locking elements at the end wall of the extending portion are received between the spaced-apart free ends of the transverse wall and into locking engagement with said complementary dovetail locking elements.

* * * * *